US006419516B1

(12) United States Patent
Parcet

(10) Patent No.: US 6,419,516 B1
(45) Date of Patent: Jul. 16, 2002

(54) JUNCTION BOX CONNECTOR SHROUD

(75) Inventor: Josep Parcet, Inkster, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 09/820,118

(22) Filed: Mar. 28, 2001

Related U.S. Application Data

(60) Provisional application No. 60/230,885, filed on Sep. 7, 2000.

(51) Int. Cl.[7] ..... H01R 13/627
(52) U.S. Cl. ..... 439/364; 439/76.2
(58) Field of Search ..... 439/76.2, 78, 83, 439/362, 364

(56) References Cited

U.S. PATENT DOCUMENTS

| | | | |
|---|---|---|---|
| 4,555,638 | A | 11/1985 | Lobe |
| 4,627,759 | A | 12/1986 | Kato et al. |
| 4,811,168 | A | 3/1989 | Chesnut et al. |
| 4,957,449 | A | 9/1990 | Hatagishi |
| 5,217,386 | A | 6/1993 | Ohsumi et al. |
| 5,334,043 | A | 8/1994 | Dvorak et al. |
| 5,475,566 | A | 12/1995 | Rada et al. |
| 5,556,288 | A | 9/1996 | Ishii et al. |
| 5,764,487 | A | 6/1998 | Natsume |
| 5,872,333 | A | 2/1999 | Uezono et al. |
| 5,934,926 | A | 8/1999 | Gabrisko et al. |
| 5,959,248 | A | 9/1999 | Ishiguro |
| 6,034,876 | A | 3/2000 | Ohno et al. |
| 6,257,918 | B1 * | 7/2001 | Yamamoto ..... 439/364 |

* cited by examiner

*Primary Examiner*—Khiem Nguyen
(74) *Attorney, Agent, or Firm*—Brooks & Kushman P.C.

(57) ABSTRACT

A junction box assembly includes a junction box housing having at least one opening formed therein. A plastic shroud is positioned within the opening and forms a pocket having side walls and a bottom wall. An upstanding threaded connector boss extends upwardly from the bottom wall. The boss forms a connector opening therethrough. A printed circuit board is attached to the bottom wall by a shroud bolt which engages the connector opening. The printed circuit board includes connector blades which penetrate the shroud pocket bottom wall and extend into the pocket formed by the shroud. An electrical connector is attached to the shroud by a connector bolt which engages the connector opening.

9 Claims, 2 Drawing Sheets

JUNCTION BOX CONNECTOR SHROUD

CROSS-REFERENCE TO RELATED APPLICATION

This application claims the benefit of U.S. provisional application Ser. No. 60/230,885, filed Sep. 7, 2000.

BACKGROUND OF THE INVENTION

1. Field of the Invention

The present invention relates to a junction box assembly including a separate shroud configured for attachment to a printed circuit board, and including a connector opening which receives a shroud attachment bolt and a connector bolt.

2. Background Art

Vehicle junction boxes may be located at a variety of positions within a vehicle, and typically include an injection molded plastic junction box housing having a pair of printed circuit boards enclosed therein. A fuse board is exposed on one side of the junction box housing for access by a vehicle occupant or service technician. On an opposing side of the junction box housing, a plurality of pockets are formed for receiving electrical connectors, such as bolt-driven electrical connectors. These pockets are formed as part of the junction box housing, and include sidewalls and a pocket bottom. An array of holes are formed through the pocket bottom to receive a corresponding array of connector blades which protrude from one of the printed circuit boards. Accordingly, the connector blades extend into the interior of the pocket for mating engagement with a bolt-driven electrical connector when the bolt-driven electrical connector is inserted into the pocket.

In the center of each pocket, a plastic bolt opening is formed to receive a single connector bolt which attaches the bolt-driven electrical connector to the junction box housing. Also, there is typically a 2–3 mm gap between the pocket bottom and the printed circuit board from which the connector blades extend.

A problem with this design is that when the connector bolt is inserted through the connector, and torqued down into the threaded opening in the junction box housing, the pocket bottom tends to flex upwardly, and the printed circuit board from which the connector blades extend tends to flex downwardly. This flexing is caused by insertion forces of the connector acting on the connector blades, which bows the printed circuit board downwardly while the torqueing of the connector bolt pulls the pocket bottom upwardly.

Accordingly, if viewed in a vertical cross section, the pocket bottom would bow upwardly in a concave manner, and the adjacent printed circuit board would bow downwardly in a concave manner such that the gap between the printed circuit board and the pocket bottom is greater near the center of the pocket than near the periphery of the pocket. This behavior necessitates highly restrictive tolerancing for the junction box housing, openings, printed circuit board and connector blades.

This design also causes blade alignment problems which may result in reduced integrity of engagement between the wire harness connector female terminals and the PCB male blades, due to distortion of mating forces. In other words, the connector blades may not properly engage with the corresponding female mating components within the connector because the connector blades are positioned at an angle due to the bending of the printed circuit board.

Another problem with this design is that the threaded opening in the junction box housing pocket for receiving the connector bolt is plated, and when the connector bolt is torqued into this plated opening, metal shavings may drop down onto the printed circuit boards, which could potentially cause shorts.

SUMMARY OF THE INVENTION

The present invention overcomes the above-referenced shortcomings of prior art junction box assemblies by providing a junction box housing having at least one opening formed therein to receive a connector shroud. The connector shroud forms a pocket to receive a connector. The bottom wall of the pocket is attached to a printed circuit board. The bottom wall of the pocket also includes an upstanding threaded connector opening which receives a shroud bolt for attaching the printed circuit to the bottom wall of the shroud pocket, and also receives a connector bolt for attaching the connector into the shroud pocket. Accordingly, because the shroud bolt maintains the distance between the printed circuit board and the bottom wall, there is no relative gap movement and no bowing between the two when the connector bolt is torqued down, thereby eliminating the tolerancing problems discussed above.

More specifically, the present invention provides a junction box housing including at least one opening formed therein. A plastic shroud is positioned within the opening. The shroud forms a pocket having sidewalls and a bottom wall. An upstanding threaded connector opening extends upwardly from the bottom wall. The shroud pocket bottom wall is attached to a printed circuit board by a shroud bolt which extends into the upstanding threaded connector opening. Connector blades extend from the printed circuit board through holes in the shroud pocket bottom wall, and into the pocket formed by the shroud. A connector is attached to the shroud by a connector bolt which is threadedly engaged with the upstanding threaded connector opening.

Accordingly, an object of the invention is to provide an improved junction box assembly in which a printed circuit board is attached in a non-flexed configured to ease tolerancing requirements for various components of the assembly and to improve blade alignment problems between the connector blades and the electrical connector.

Another object of the invention is to prevent metal shavings from dropping onto the printed circuit boards when a connector bolt is torqued into a plated connector opening.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
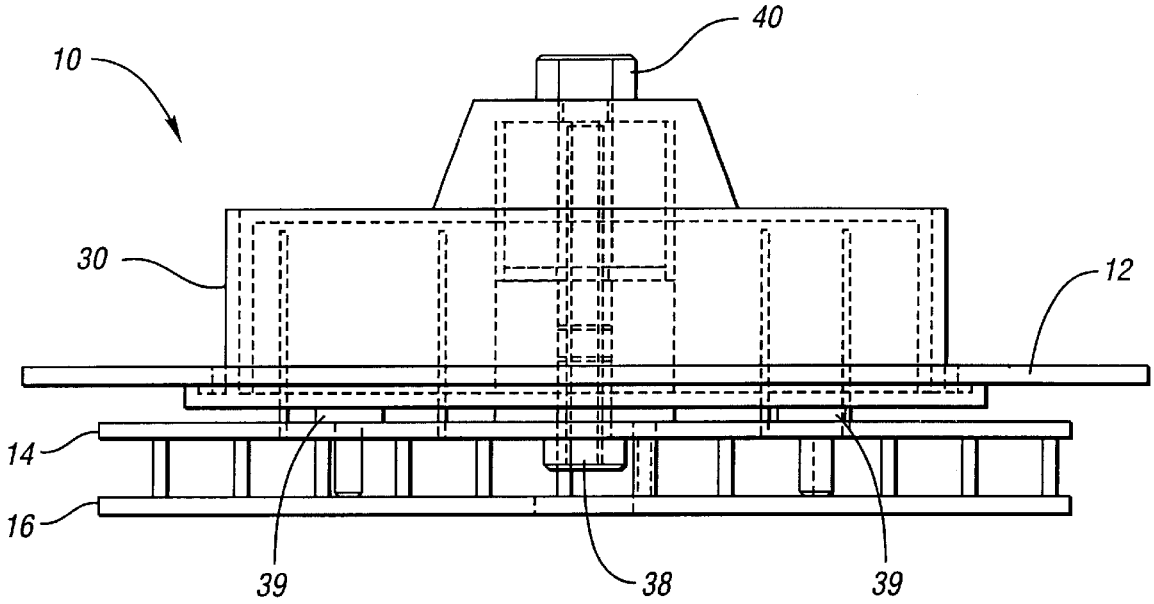
FIG. 1 is a side view of a junction box assembly in accordance with the present invention.
Figure 3:
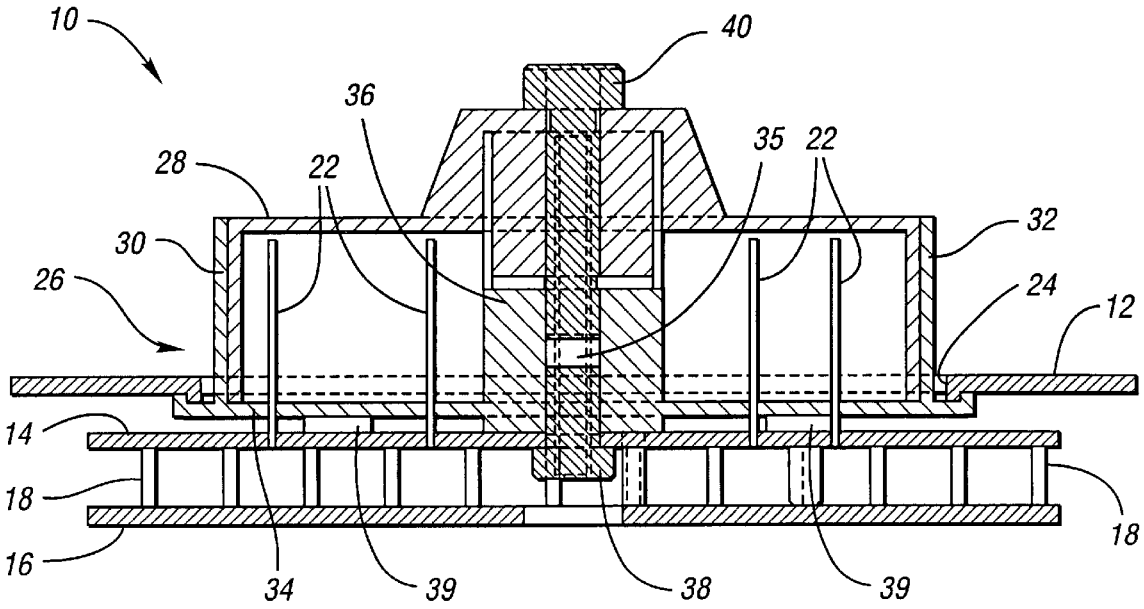
FIG. 3 is a vertical cross-sectional view taken at line 3–3 of FIG. 2.
Figure 2:
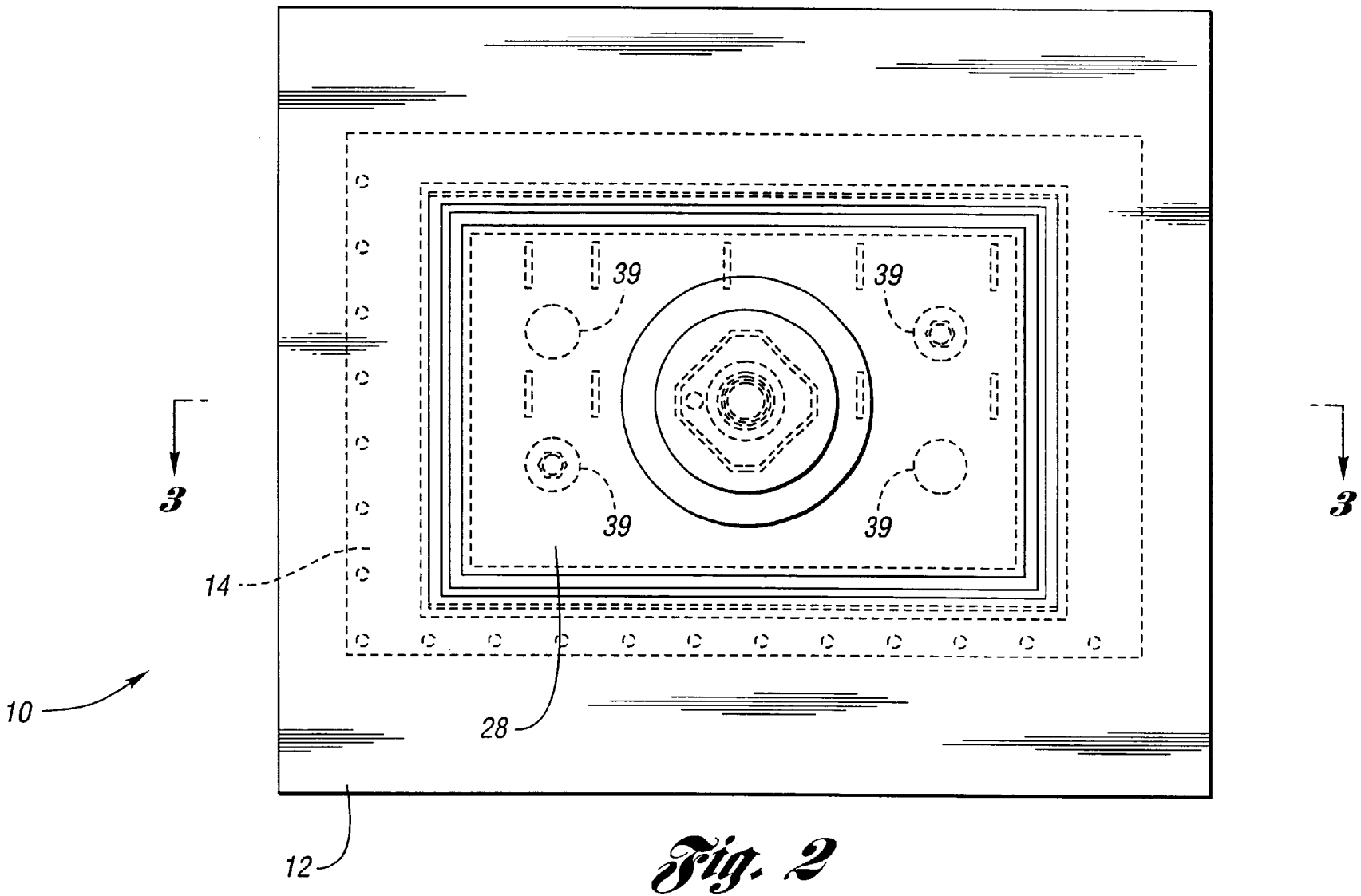
FIG. 2 is a plan view of the junction box assembly of FIG. 1.

Referring to FIGS. 1–3, a junction box assembly 10 is shown in accordance with the present invention. As shown, the junction box housing 12 is a plastic component which houses the first and second printed circuit boards 14,16. The printed circuit boards 14, 16 are connected together by pins 18. Arrays of connector blades 22 extend from the printed circuit board 14.

As most clearly shown in FIG. 3, the junction box housing 12 forms an opening 24 for receiving a plastic shroud 26 which is operative to attach the bolt-driven electrical connector 28 to the printed circuit board 14. The bolt-driven electrical connector 28 (which is shown schematically) is preferably a forty-two way connector.

The shroud 26 includes sidewalls 30,32 which cooperate with the bottom wall 34 to form a pocket for receiving the connector 28. The bottom wall 34 of the shroud 26 includes holes (not shown) through which the connector blades 22 pass from the printed circuit board 14. An upstanding threaded connector boss 36 extends upwardly from the bottom wall 34 and includes a plated opening 35. A shroud bolt 38 connects the printed circuit board 14 flat against standoff legs 39, which protrude from the lower surface of the bottom wall 34, by threaded engagement with the upstanding threaded connector boss opening 35. Accordingly, the printed circuit board 14 is connected flush against the standoff legs 39 on the bottom wall 34 of the shroud 26, and then fixed to the shroud bottom wall 34 by the shroud bolt.

The printed circuit board 14 and bottom wall 34 may also be connected together at other locations such as by a corresponding pin and hole to maintain proper engagement between the two components. A connector bolt 40 attaches the connector 28 to the shroud 26 by engagement with the upstanding threaded connector opening 36. Because the shroud bolt 38 previously attaches the printed circuit board to the shroud, any forces from torqueing down the connector bolt 40 are taken up by the shroud bolt, thereby preventing bending of the printed circuit board 14 and the bottom wall 34, which eliminates the problems with bowing discussed in the Background Art section of this description. The shroud bolt 38 maintains a consistent gap between the printed circuit board 14 and the bottom wall 34, and the shroud bolt 38 cooperates with the standoff legs 39 to maintain the printed circuit board parallel with the shroud bottom wall 34.

This invention provides several advantages. As discussed above, a major advantage of this invention is that it improves tolerances between the various components, particularly because the bowing of the printed circuit board and pocket bottom wall are reduced or completely eliminated, which eliminates alignment problems between the connector blades 22 and the female connector members (not shown) within the connector 28. Also, because the shroud 26 is injection molded as a separate component which is much smaller than the junction box housing 12, it is much easier to control tolerance of various holes and walls of this component because shrinkage of the plastic is not spread over a larger area.

By including the smaller part (the shroud bottom 34), it is easier to hold tolerances for the connector blade openings. Accordingly, the connector blade openings can be smaller which will help support the connector blades 22 and ease the positional blade tolerances.

Also, the prior art problem of metal shavings is eliminated, because when the connector bolt 40 is torqued into the upstanding threaded connector opening 36, any metal shavings will simply pile up on top of the shroud bolt 38, and will not reach the printed circuit board 14.

Also, because the shroud bolt 38 maintains a consistent gap between the bottom wall 34 of the shroud 26 and the printed circuit board 14, the connector blades 22 extend to a consistent depth through the bottom wall 34, thereby improving engagement between the connector blades 22 and the corresponding female connector members within the connector 28. Also, pocket strength is increased and stress on the plastic and sub-assembly is reduced when the connector 28 is mated with the connector blades 22.

Preferably, the junction box housing 12 and shroud 26 are a Norel non-filled plastic material, available from General Electric Company of Pittsfield, Mass. However, a variety of materials would work in this application.

While the best mode for carrying out the invention has been described in detail, those familiar with the art to which this invention relates will recognize various alternative designs and embodiments for practicing the invention without departing from the spirit and scope of the invention as defined in the appended claims.

What is claimed is:

1. A junction box assembly comprising:

a junction box housing including at least one opening formed therein;

a plastic shroud positioned within the opening and forming a pocket having side walls and a bottom wall, and having an upstanding threaded connector boss extending upwardly from the bottom wall, said boss forming a connector opening therethrough;

a printed circuit board attached to said bottom wall by a shroud bolt which engages the connector opening, said printed circuit board including connector blades which penetrate the shroud pocket bottom wall and extend into the pocket formed by the shroud; and an electrical connector attached to the shroud by a connector bolt which engages the connector opening.

2. The junction box assembly of claim 1, further comprising a second printed circuit board connected by pins to the first printed circuit board.

3. The junction box assembly of claim 1, wherein said shroud comprises injection-molded plastic.

4. The junction box assembly of claim 3, wherein the electrical connector is a forty-two way connector.

5. The junction box assembly of claim 3, wherein said shroud is a unitary component manufactured separately from the junction box housing.

6. The junction box assembly of claim 1, wherein said threaded connector boss is configured to trap metal shavings in the connector opening when the shroud bolt and connector bolt are torqued into the connector opening, thereby preventing metal shavings from depositing on the printed circuit board.

7. A junction box assembly comprising:

a junction box housing including at least one opening formed therein;

a plastic shroud positioned within the opening and forming a pocket having side walls and a bottom wall, and having an upstanding threaded connector boss extending upwardly from the bottom wall, said boss forming a connector opening therethrough;

a printed circuit board attached to said bottom wall by a shroud bolt which engages the connector opening, said printed circuit board including connector blades which penetrate the shroud pocket bottom wall and extend into the pocket formed by the shroud; and an electrical connector attached to the shroud by a connector bolt which engages the connector opening;

wherein said threaded connector boss is configured to trap the metal shavings in the connector opening when the shroud bolt and connector bolt are torqued into the connector opening, thereby preventing metal shavings from depositing on the printed circuit board.

8. A junction box assembly comprising:

a junction box housing including at least one opening formed therein;

a plastic shroud positioned within the opening and forming a pocket having side walls and a bottom wall with standoff legs protruding therefrom, and having an upstanding threaded connector boss extending upwardly from the bottom wall, said boss forming a connector opening therethrough;

a printed circuit board attached to said bottom wall against the standoff legs by a shroud bolt which engages the connector opening and secures the printed circuit board in a flat, unbent condition against the standoff legs, said printed circuit board including connector blades which penetrate the shroud pocket bottom wall and extend into the pocket formed by the shroud; and an electrical connector attached to the shroud by a connector bolt which engages the connector opening.

9. The junction box assembly of claim 8, wherein the connector opening is positioned substantially in the center of the shroud.

* * * * *